US006301771B1

(12) United States Patent
Benoit

(10) Patent No.: US 6,301,771 B1
(45) Date of Patent: Oct. 16, 2001

(54) METHOD OF MANUFACTURING A CHASSIS FOR A GLIDING SPORT

(75) Inventor: Louis Benoit, La Balme De Sillingy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 08/736,995

(22) Filed: Oct. 25, 1996

(30) Foreign Application Priority Data

Nov. 14, 1995 (FR) ..... 95 13707

(51) Int. Cl.[7] ..... B23P 13/04

(52) U.S. Cl. ..... 29/557; 280/841; 280/11.19; 280/11.22; 280/11.27

(58) Field of Search ..... 280/841, 11.19, 280/11.22, 11.23, 11.27; 29/557

(56) References Cited

U.S. PATENT DOCUMENTS

| | | | | |
|---|---|---|---|---|
| 275,482 | * | 4/1883 | Gregg | 280/11.19 |
| 875,165 | * | 12/1907 | Faust et al. | 280/11.19 |
| 1,294,984 | * | 2/1919 | Ware | 280/11.19 |
| 1,807,890 | * | 6/1931 | Berger | 280/11.27 X |
| 1,977,587 | | 10/1934 | MacDonnell | 208/167 |
| 2,291,600 | * | 8/1942 | Atkinson | 280/11.23 X |
| 2,531,357 | * | 11/1950 | Foulds | 280/11.27 X |
| 4,273,345 | | 6/1981 | Ben-Dor et al. | 280/11.2 |
| 5,388,846 | | 2/1995 | Gierveld | 280/11.22 |
| 5,735,536 | * | 4/1998 | Myers et al. | 280/11.22 X |

FOREIGN PATENT DOCUMENTS

| | | |
|---|---|---|
| 105264 | 6/1924 | (CH) . |
| 1033569 | 7/1958 | (DE) . |
| 0043250 | 1/1982 | (EP) . |
| 495821 | 10/1919 | (FR) . |
| 943511 | 3/1949 | (FR) . |

* cited by examiner

*Primary Examiner*—P. W. Echols
(74) *Attorney, Agent, or Firm*—Greenblum & Berstein, P.L.C.

(57) ABSTRACT

The chassis includes at least one support surface capable of receiving a boot and at least one lateral flange to which the gliding member(s) is (are) attached, as well as at least one stiffening rib obtained on at least one of the flanges by pressing. The manufacturing method includes the steps of cutting in a metallic sheet a form corresponding substantially to the completed form of at least one portion of the chassis, and obtaining at least one stiffening rib by pressing in the portion of the chassis.

37 Claims, 3 Drawing Sheets

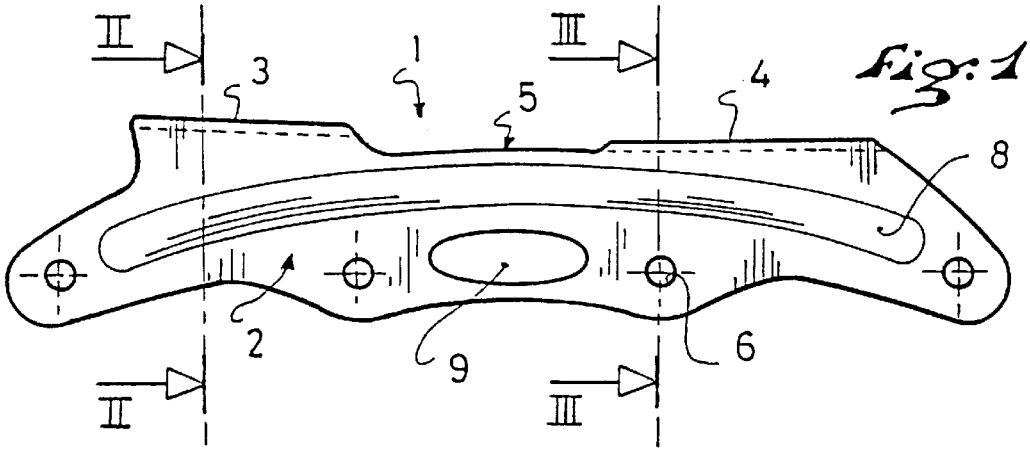
Fig: 1
Fig: 2
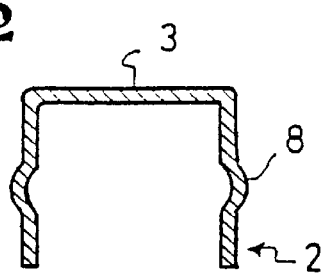
Fig: 3
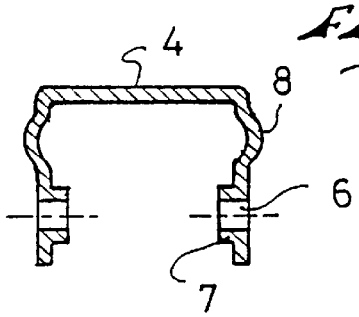
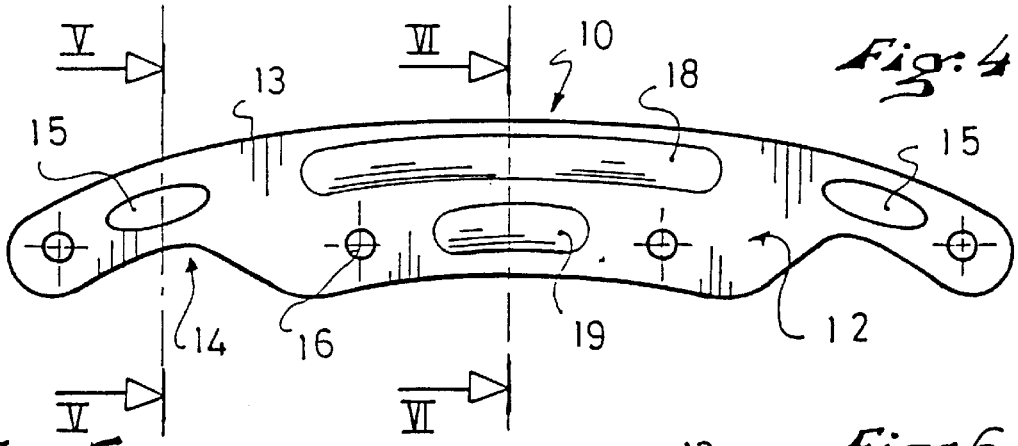
Fig: 4
Fig: 5
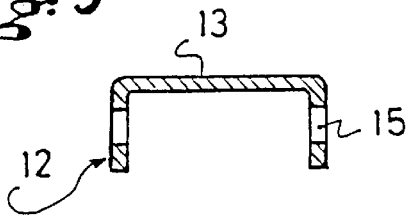
Fig: 6
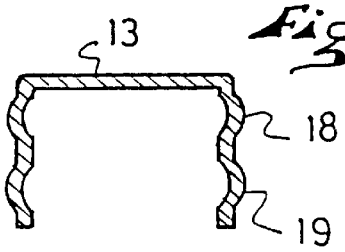

METHOD OF MANUFACTURING A CHASSIS FOR A GLIDING SPORT

BACKGROUND OF THE INVENTION

1. Field of the Invention

The present invention relates to a chassis for a sport gliding element such as a roller skate, an ice skate, and a method for manufacturing such a chassis.

2. Description of Background and Relevant Information

Such chassis must ensure the linkage between the gliding member(s) themselves, namely skate blade or wheels, rollers, and the user's foot.

The chassis is therefore generally constituted by a support surface that is capable of receiving the boot of the athlete, and by one or two lateral flanges adapted to receive the wheels, rollers or the blade of the skate.

They must also have substantial mechanical resistance characteristics while being as light as possible so as not to require too substantial forces from the athlete.

Furthermore, the increasing technicality of these sport gliding elements, especially for in-line roller skates, further increases the conflicting requirements which must be met by the skate chassis, namely:

- an increased mechanical resistance and stability, especially for speed skates, but also for the so-called free ride, free style or hockey skates;
- some flexibility, especially in certain zones of the skate, to enable the shape of the skate to adapt to the trajectory covered, especially in curves at high speed;
- various and original forms to meet the emerging and changing fashion requirements; and
- a lowest possible manufacturing cost.

The techniques used in manufacturing the currently known chassis do not make it possible to meet all of these requirements while maintaining a reasonable manufacturing cost.

Indeed, the oldest manufacturing technique consists of making such chassis from a U-shaped bent metal sheet, as shown in the document DE 10 33 569, for example.

Such a manufacturing principle, while inexpensive, does not however make it possible to create a large variety of forms, nor a chassis with substantial mechanical resistance, unless the thickness of the metal sheet, and therefore the weight thereof, are substantially increased.

Another commonly used technique consists of making the chassis by molding from a synthetic or metallic material. Molding offers the advantage of creating various forms, but it also has numerous disadvantages:

- costs of the molds;
- limited selection of materials capable of being molded;
- low mechanical resistance characteristics of these molding materials, even when they are metallic, and
- insufficient molding precision, requiring additional machining, especially with respect to alignment of the holes for fixing the wheels or the skate blade of a two-flange chassis.

Chassis made of composite fibers are also known. These chassis can indeed be obtained in almost all possible forms, but their manufacture is extremely expensive and difficult to industrialize. Furthermore, while such chassis are extremely rigid, they lack flexibility and are therefore fragile and "uncomfortable."

Finally, the U.S. Pat. No. 5,388,846 has proposed to make a chassis for ice skates or roller skates from a profiled, or extruded metallic bar whose transverse section corresponds to the general section desired for the chassis, the final form of the chassis being obtained after machining with removal of material.

Such a manufacturing method is also very expensive, due to the necessary machining period and to the quantity of material to be removed. It does not allow a great freedom with respect to the form or profile of the chassis.

SUMMARY OF THE INVENTION

The object of the present invention is to remedy these drawbacks and to provide an improved chassis for a sport gliding element, as well as a method for manufacturing such chassis, which method makes it possible to resolve the various aforementioned problems and, in particular, to conciliate the characteristics of mechanical resistance, adaptability, manufacturing flexibility, lightness, and a low manufacturing cost.

This object is achieved in the manufacturing method according to the invention due to the fact that it includes the steps consisting of:

- cutting in a metallic sheet a form corresponding substantially to the completed form of at least one portion of the chassis; and
- obtaining at least one stiffening rib by pressing in such portion of the chassis.

Indeed, stiffening the chassis by means of stiffening ribs obtained by pressing enables, at equal weight with respect to a chassis merely made by bending, a substantial increase in the characteristics of rigidity and resistance to deformation due, on the one hand, to the presence of such ribs, but also to the localized work hardening of the material obtained in the area of such ribs related to the manufacturing method by pressing.

Depending on the desired results, one can provide each rib to extend substantially along the entire length of the flange of the chassis, or only over a limited central zone of each flange, or yet in the area of the ends of each flange.

BRIEF DESCRIPTION OF DRAWINGS

The invention will be better understood and other characteristics will become apparent along the description that follows, with reference to the annexed schematic drawing showing, by way of non-limiting examples, a plurality of embodiments of the chassis, and in which:

FIG. 1 is a side view of a chassis according to a first embodiment;

FIG. 2 is a cross-sectional view along the line II—II of FIG. 1;

FIG. 3 is a cross-sectional view along the line III—III of FIG. 1;

FIG. 4 is a side view of a chassis according to a second embodiment;

FIG. 5 is a cross-sectional view along the line V—V of FIG. 4;

FIG. 6 is a cross-sectional view along the line VI—VI of FIG. 4;

DETAILED DESCRIPTION OF THE PREFERRED EMBODIMENTS

Figure 7:
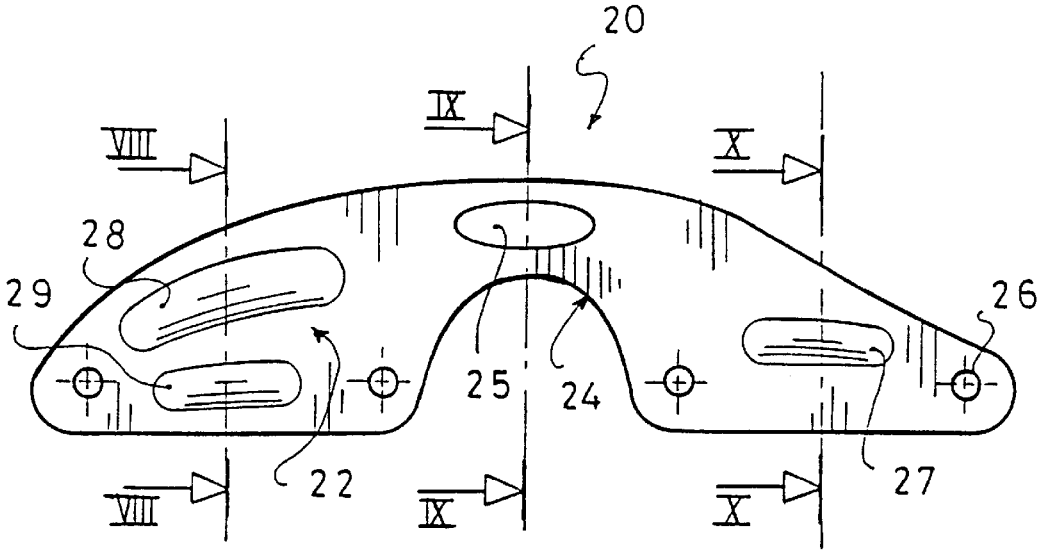
FIG. 7 is a side view of a chassis according to a third embodiment.
Figure 8:
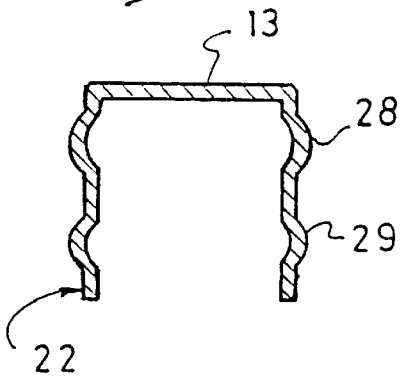
FIG. 8 is a cross-sectional view along the line VII—VII of FIG. 7.
Figure 9:
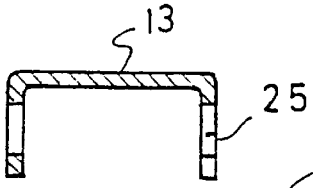
FIG. 9 is a cross-sectional view along the line IX—IX of FIG. 7.
Figure 10:
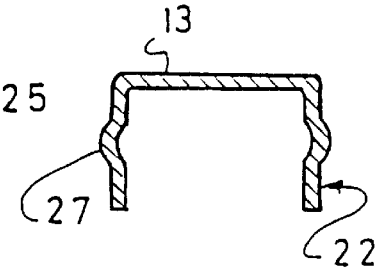
FIG. 10 is a cross-sectional view along the line X—X of FIG. 7.

As shown in FIGS. 1–3, the chassis according to the invention is made from a metal sheet, and has the general form of two lateral flanges 2 connected to each other by two platforms 3, 4, providing the assembly with a substantially U-shaped transverse section.

Each of the platforms 3, 4, constitutes a support surface capable of receiving the boot of the athlete, the latter (not shown in the drawing) is fixed by any known means, especially glue, rivets, screws, etc., but it can also be fixed removably by non-permanent connection means.

One will also note that the platforms 3, 4, are distinct and separated from one another by a cutout 5, and they are located at different levels in height, the platform 4 being lower than the platform 3, to take into account the natural position of the athlete, in which the heel is slightly raised.

Each flange 2 has an elongated form that is bent in an arc of a circle in the longitudinal direction.

Holes 6 for the attachment of the rollers or of the skate blade, as the case may be, are provided at the lower end of each flange.

Each hole 6 is made in a cylindrical boss 7 that can be obtained by die forging. The holes 6 located correspondingly in the two flanges are coaxial.

Each flange 2 further has a pressed rib 8 that extends substantially along the entire length of the flange 2, above the attachment holes 6, and has a generally arched aspect.

As shown particularly in FIGS. 2 and 3, each rib 8 has a substantially constant thickness corresponding to that of the metal sheet constituting the flanges 2 and each of the platforms 3, 4, and it has a recessed form which is curved outwardly, this recessed form and the constant thickness being characteristic of a form obtained by pressing.

Furthermore, each rib 8 preferably follows the contour of the flanges 1, 2, on which is pressed and therefore has, in this case, an elongated form which is also slightly curved continuously in the longitudinal direction, a center portion being relatively raised with respect to end portions.

Such a pressed rib 8 provides the flange, on which it is obtained, with a substantial increase in the moment of inertia and of resistance to deformation both in the longitudinal and vertical directions, this increase being related not only to the presence of each rib 8 and the shape thereof, but also to the work hardening of the material in the rib area during the pressing operation.

Such a construction and manufacturing concept practically makes it possible to divide in two the thickness, and therefore the weight of the metal sheet used to make the chassis with respect to a bent, molded or extruded chassis, while maintaining, or even increasing, the mechanical characteristics.

This method therefore provides for the manufacture of an extremely light, resistant and inexpensive chassis.

Advantageously, the chassis will be made from a laminated metal sheet whose fibers are oriented along the longitudinal direction of the chassis. Such a characteristic also makes it possible to increase the resistance qualities of the chassis in the longitudinal direction, especially with respect to a chassis made of an injected or cast alloy in which there is no formation of fibers.

Furthermore, it is possible to modify/modulate the moment of inertia of the chassis by providing appropriate cutouts such as 5, 9.

In the present case, the cutout 9, which is oval and arranged centrally beneath the rib 8, makes it possible to reduce the flexional stiffness of each flange 2 in the central zone of the chassis and, in combination with the cutout 5 which is also arranged centrally, also makes it possible to reduce the flexional stiffness of the entire chassis in this zone.

Such a chassis can be made very simply and in a single piece from a metallic sheet in a succession of the following steps:

- first, the sheet is precut in a form corresponding to the completed form of the chassis with an increased surface in the zone of each rib to take into account the shrinking of material during the pressing;
- all cutouts such as 5 and 9 are also made during this first die cutting operation;
- the two ribs 8 of the two flanges 1, 2 are then made by pressing;
- the holes 6 are then made by extrusion and are possible threaded; after a preliminary die forging of the bosses 7;
- the metal sheet is finally bent into a U-shape.

Of course, the series of operations described above only applies if the chassis is made in a single piece from the same metallic sheet.

It can also be manufactured from a plurality of portions assembled by any known means, such as screws, rivets, welds, etc.

More particularly, each chassis can be constituted by two flanges having a generally "L"-shaped transverse section and being connected to one another by the small arm of each "L".

With respect to an aluminum chassis made of an alloy made by injection during molding, such a manufacturing technique by pressing, and possibly by die forging, bending, is much more precise, does not require any subsequent machining, and makes it possible to have a greater selection of material, with more interesting characteristics. Indeed, the number of available materials for injection or molding is very limited, and these materials are generally brittle and do not promote the formation of fibers.

Moreover, since the molding and injection techniques are not sufficiently precise, time-consuming and expensive additional machining would be necessary to provide the holes for attaching the gliding member(s), for example.

One will also note that the geometrical qualities of a pressed chassis are clearly greater than those of a chassis made out of plastic materials, in which, due to the shrinking of the material, one is confronted with the phenomena of twisting and alignment of the wheels attachment holes requiring additional machining.

By way of example, the necessary periods to produce a chassis using the various techniques can be assessed as follows:

plastic material . . . 15 seconds profiled and machined aluminum . . . 180 seconds cast aluminum . . . 85 seconds pressed aluminum . . . 6 seconds Therefore, by using the pressing technique according to the invention, advantages are realized in terms of a reduction in manufacturing time and costs, advantageous characteristics of the material used for the chassis, and a relative lightness of the completed chassis.

Another extremely advantageous characteristic of the pressing technique resides in the fact that the possibilities in terms of design are greater than those of the extruded profile that does not allow any embossing or form on the sides of the profile which are necessarily planar.

Furthermore, the method and construction of the chassis according to the invention offer great possibilities in varying the moment of inertia of the chassis along the longitudinal axis thereof, by providing adapted ribs, cutouts, or heights for the sides, in order to obtain a deformation of the chassis and an optimum behavior of the skate as a function of the desired practice.

Thus, the chassis described with reference to FIGS. 1–3 offers a quasi uniform rigidity along its entire length whereas the other two examples of chassis shown in FIGS. 4–6 and 7–10 make it possible to obtain different behaviors.

The chassis 10 shown in FIGS. 4–6 includes, as is the case for the chassis 1, two lateral flanges 12, but a single platform 13 extending along its entire length.

The chassis 10 further has a form that is clearly curved in an arc of a circle.

Each flange 12 has at each end a cutout 15 as well as a perimetric narrowing 14 providing it with flexibility and a low moment of inertia in these zones.

Conversely, each flange 12 is provided in its median zone with two superimposed pressed ribs 18, 19.

Such a chassis therefore has a very substantial rigidity in the center, in the zone of ribs 18, 19, and relatively flexible ends.

The chassis 20 shown in FIGS. 7–10 includes, as is the case for the chassis 10, two lateral flanges 22 and a single platform 13 extending along its entire length.

It also has the shape of an arc or a circle. Each flange 22 has:

two superimposed ribs 28, 29 at its rear end, at least the rib 28 extending forwardly in a continuous curved shape;

a cutout 25 and a perimetric narrowing 24 in its central zone; and a single rib 27 at its front end.

Such a chassis will therefore be very rigid at the rear, very flexible in the center, and moderately rigid at the front.

Figure 11:
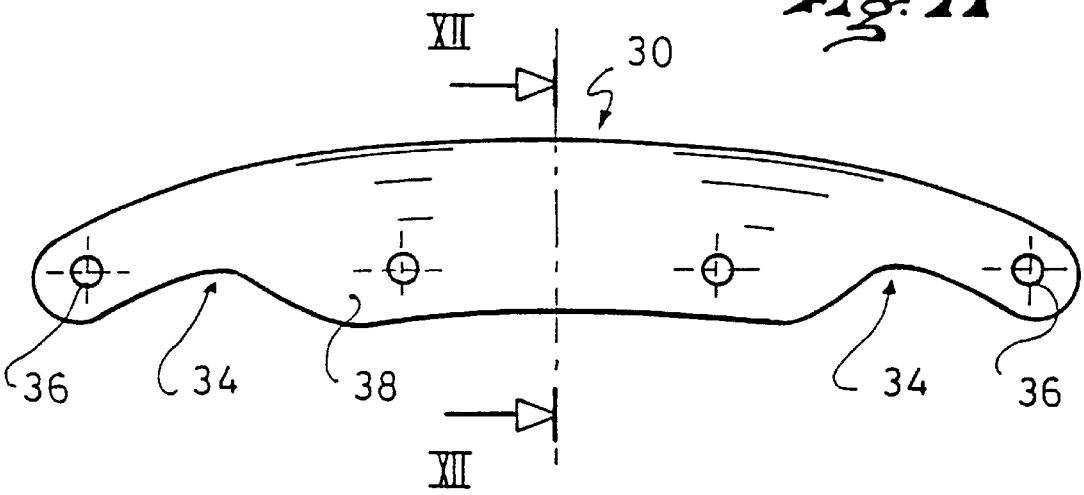
FIG. 11 is a side view of a chassis according to a fourth embodiment.
Figure 12:
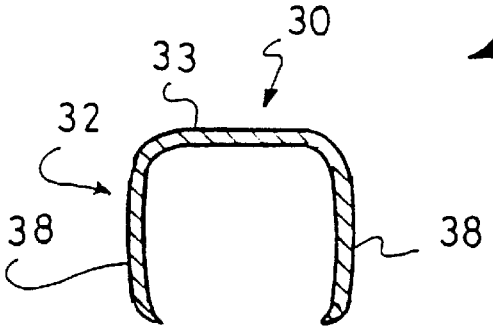
FIG. 12 is a cross-sectional view along the line XII—XII of FIG. 11.
Figure 13:
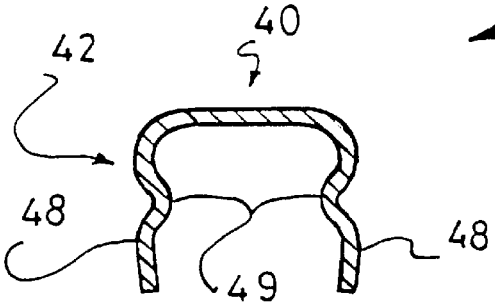
FIG. 13 is a view similar to FIG. 12 showing yet another embodiment.

FIGS. 11–13 also show other embodiments of a chassis.

In the case of FIGS. 11 and 12, each lateral flange 32 of the chassis 30 is pressed over its entire surface and therefore constitutes a large and single rib 38 which is slightly curved outwardly.

Therefore, such a chassis has particularly homogeneous characteristics of torsional and flexional rigidity along its entire length, the only more flexible zones being defined at the front and rear by scallops 34.

Finally, FIG. 13 shows yet another example of cross pressing of the lateral flanges 42 of a chassis 40, in which each flange is pressed outwardly a first time, then inwardly a second time, thus defining two external "ribs" 48 and one internal median rib 49.

Of course, a simple pressing of each internal rib 49 is also possible.

Of course, the present invention is not limited to the examples of embodiment shown hereinabove. It can apply to any chassis for a sport element that must meet the same requirements.

The instant application is based upon French Patent Application No. 95.13707, filed on Nov. 14, 1995, the disclosure of which is hereby expressly incorporated by reference thereto, and the priority of which is hereby claimed.

What is claimed is:

1. A method of manufacturing a U-shaped chassis for a gliding sport device, of the type comprising at least one support surface capable of receiving a boot, and a pair of laterally spaced-apart flanges, said flanges comprising means for attaching gliding member(s), said method comprising:

cutting in a metallic sheet a form corresponding substantially to a completed form of at least one portion of the chassis, including at least one cutout in said at least one portion of the chassis; and forming at least one stiffening rib by pressing in at least said one portion of the chassis, said stiffening rib extending along said one portion of said chassis non-linearly.

2. A method of manufacturing a U-shaped chassis according to claim 1, said cutting further comprising cutting a completed form of the chassis, and creating a final form of the chassis after bending into a U, following said pressing.

3. A method according to claim 2, wherein:

said bending into a U comprises bending said form to create said at least one lateral flange, said one lateral flange constituting a portion of said U and said one portion of said chassis.

4. A method according to claim 1, further comprising:

bending said form to create said at least one lateral flange.

5. A method according to claim 4, wherein:

said chassis is longitudinally elongated;

said cutting includes cutting cutouts in a longitudinally central portion of said chassis for reducing flexional stiffness of said at least one lateral flange; and said pressing obtains said at least one stiffening rib at least in said longitudinally central portion of said chassis for increasing resistance to deformation of said at least one lateral flange.

6. A method according to claim 5, wherein:

said pressing obtains said at least one stiffening rib in an arched configuration that extends a majority of the length of said at least one lateral flange.

7. A method according to claim 6, wherein:

both said at least one stiffening rib and said at least one lateral flange have similar arched configurations.

8. A method according to claim 1, wherein said pair of flanges of said U-shaped chassis is formed from two distinct L-shaped flanges, each of said L-shaped flanges having a smaller arm and a larger arm, said method further comprising:

bending said form to create one of said pair of L-shaped flanges;

bending a second form to create a second of said pair of L-shaped flanges; and connecting together said smaller arms of said pair of L-shaped flanges to create said U-shaped chassis.

9. A method of manufacturing a chassis for a gliding sport device adapted to have a boot attached upon the chassis, said method comprising:

creating a form from a sheet of metallic material for subsequent processes for manufacturing at least a portion of said chassis;

pressing a predetermined portion of said form to create a stiffening rib extending along said predetermined portion of said chassis non-linearly; and bending said form to create at least one flange of the chassis, said flange having said stiffening rib.

10. A method according to claim 9, wherein:

said creating comprises creating a form from a sheet of metallic material for subsequent processing for manufacturing the entirety of the chassis;

said pressing comprises pressing at two predetermined portions of said form to create at least two stiffening ribs; and said bending comprises bending said form to create a substantially U-shaped chassis having two substantially parallel flanges, each of said flanges having a respective stiffening rib.

11. A method according to claim 9, further comprising:

before said bending, cutting predetermined elongated openings for reducing flexional stiffness of said chassis following completed manufacture.

12. A method according to claim 11, whereby said chassis is a chassis for a skate to be fitted with at least one gliding member, said method further comprising:

before said bending, forming holes having a size and position for mounting the gliding member.

13. A method according to claim 9, wherein:

said pressing comprises pressing said at least one stiffening rib to extend substantially longitudinally along substantially the entirety of said flange.

14. A method according to claim 9, wherein:

said pressing comprises pressing said at least one stiffening rib to extend along a limited zone of said flange, less than along substantially the entirety of said flange.

15. A method according to claim 9, wherein:

said flange of said chassis includes an external surface and an internal surface;

said pressing comprises pressing said at least one stiffening rib to extend from said internal surface of said flange.

16. A method according to claim 9, wherein:

said flange of said chassis includes an external surface and an internal surface;

said pressing comprises pressing said at least one stiffening rib to extend from said external surface of said flange.

17. A method according to claim 9, wherein:

said creating a form from a sheet of metallic material comprises cutting a form from a sheet of metallic material.

18. A method according to claim 13, wherein:

said pressing comprises pressing said at least one stiffening rib to extend along a limited length of said flange, less than along the entire length of said flange, thereby leaving opposite end portions of said flange substantially flat.

19. A method of manufacturing a chassis for a gliding sport device adapted to have a boot attached upon the chassis, said method comprising:

cutting in a metallic sheet a form corresponding substantially to a predetermined developed pattern of at least one portion of the chassis, including die cutting to form at least one elongated cutout within the contour of the sheet while leaving at least one predetermined zone of enlarged surface;

pressing a predetermined portion in said predetermined zone of the enlarged surface to create at least one permanent stiffening rib to compensate, at least partially, a loss of rigidity due to formation of said at least one cutout, said stiffening rib extending non-linearly along said predetermined zone of the enlarged surface of the sheet.

20. A method according to claim 19, further comprising:

forming said chassis into a U-shape having two flanges, said forming comprising bending said form to create at least one of said two flanges of said U-shape, said at least one of said two flanges having said stiffening rib.

21. A method according to claim 20, wherein:

said pressing comprises pressing at two predetermined portions of said form to create at least one stiffening rib on each of said two predetermined portions, each of said two predetermined portions comprising a respective one of said two flanges.

22. A method according to claim 20, wherein:

said flange is elongated in a substantially longitudinal direction; and said pressing comprises pressing said at least one stiffening rib to extend substantially along said longitudinal direction.

23. A method according to claim 20, wherein:

said flange is elongated in a substantially longitudinal direction; and said pressing comprises pressing said at least one stiffening rib to have a continuous shape, said continuous shape being curved in a direction extending substantially along said longitudinal direction.

24. A method according to claim 23, wherein:

said continuous curved shape has a center portion raised with respect to at least one end portion.

25. A method according to claim 20, wherein:

said pressing comprises pressing at two predetermined portions of said form to create at least one stiffening rib on each of said two predetermined portions.

26. A method of manufacturing a chassis for a gliding sport device adapted to have a boot attached upon the chassis, said method comprising:

cutting in a metallic sheet a form corresponding substantially to a predetermined pattern of at least one portion of the chassis, including die cutting at least one cutout within a perimeter of the sheet in a predetermined direction while leaving at least one zone of enlarged surface;

pressing a portion in said predetermined zone of the enlarged surface, said portion extending substantially in said predetermined direction of said cutout so as to create at least one permanent stiffening rib to compensate, at least partially, a loss of rigidity due to formation of said cutout, said stiffening rib extending non-linearly along said predetermined zone of the enlarged surface of the sheet.

27. A method of manufacturing a chassis for a gliding sport according to claim 26, in combination with a method of assembling a skate, said method of manufacturing further comprising:

bending said form to provide an upper surface for receiving said boot on said upper surface;

wherein said assembling a skate comprises attaching said boot to said upper surface of said form and attaching at least one gliding element to said chassis.

28. A method according to claim 27, wherein:

said attaching at least one gliding element to said chassis comprises attaching a plurality of in-line wheels to said chassis.

29. A method according to claim 28, wherein:

said attaching a plurality of in-line wheels to said chassis comprises assembling said wheels along respective axes of said wheels extending through holes independent of said at least one cutout.

30. A method of manufacturing a chassis for a gliding sport device adapted to have a boot attached upon the chassis, said method comprising:

cutting in a metallic sheet a form corresponding substantially to a predetermined developed pattern of at least one portion of the chassis, including die cutting to form at least one cutout within the contour of the sheet while leaving at least one predetermined zone of enlarged surface;

pressing a predetermined portion in said predetermined zone of the enlarged surface to create at least one permanent stiffening rib to compensate, at least partially, for a loss of rigidity due to formation of said cutout, said stiffening rib extending in an arch shape along said predetermined zone of the enlarged surface of the sheet.

31. A method according to claim 30, wherein:

said sheet is elongated in a substantially longitudinal direction; and said pressing comprises pressing said at least one stiffening rib to extend substantially along said longitudinal direction, said arch-shape of said stiffening rib having ends spaced apart in said longitudinal direction.

32. A method of manufacturing a frame for an in-line roller skate, adapted to have a boot supported upon the frame, said frame having a cross-sectional U-shape, said method comprising:

creating a form from a sheet of metallic material for subsequent processing for manufacturing at least a portion of said frame;

pressing predetermined portions of said form to create at least two longitudinally extending and longitudinally curved stiffening ribs;

bending said form to create a pair of spaced-apart substantially parallel flanges, each of said flanges having a respective one of said two stiffening ribs, said flanges being spaced apart a distance to receive and have mounted a plurality of wheels between said flanges.

33. A method according to claim 32, further comprising:

before said bending, cutting at least one predetermined elongated opening in each area of said form corresponding to a respective one of said flanges, for reducing flexional stiffness of said frame following completed manufacture;

each of said stiffening ribs is positioned above and extends at least partially along a respective one of said elongated openings.

34. A method according to claim 33, further comprising:

before said bending, forming holes having a size and position for mounting respective wheels of said in-line roller skate between said flanges.

35. A method of manufacturing a frame for an in-line roller skate, adapted to have a boot supported upon the frame, said frame including a pair of longitudinally extending, laterally spaced-apart flanges adapted to have a plurality of wheels mounted for rotation between said flanges, said method comprising:

cutting in a metallic sheet a form having a peripheral contour corresponding substantially to a predetermined completed shape of at least one portion of said frame corresponding to one of said flanges of said frame, including die cutting to form at least one cutout within said portion of said frame;

pressing a predetermined area of said portion of said frame to create at least one stiffening rib above said cutout, said stiffening rib extending longitudinally upwardly with respect to at least one end of said rib to form a downwardly facing concavity, said rib compensating, at least partially, for a loss of rigidity due to formation of said cutout.

36. A method according to claim 35, wherein:

said portion of said frame corresponding to one of said flanges of said frame extends longitudinally from a first boot-supporting zone, through an intermediate zone, to a second boot-supporting zone;

said pressing creates said at least one stiffening rib having longitudinally opposed ends and having a longitudinally extending curved shape, said curved shape rising from one of said ends of said rib at least to said intermediate zone of said portion of said frame.

37. A method according to claim 36, further comprising:

forming holes having a size and position for mounting respective ones of said plurality of wheels of said in-line roller skate to said flange.

* * * * *